United States Patent [19]

Jacobson

[11] 4,039,020

[45] Aug. 2, 1977

[54] CORD LOCKING DEVICE FOR BLINDS OR THE LIKE

[76] Inventor: Abraham Jacobson, 7900 Garner St., Long Beach, Calif. 90808

[21] Appl. No.: 668,181

[22] Filed: Mar. 18, 1976

[51] Int. Cl.[2] ..... E06B 9/38

[52] U.S. Cl. ..... 160/178 C; 24/134 KB

[58] Field of Search ..... 160/178 C; 24/134 KC, 24/134 KB; 74/230.01, 230.3, 230.8; 188/65.1

[56] References Cited

U.S. PATENT DOCUMENTS

| | | | |
|---|---|---|---|
| 702,165 | 6/1902 | Tryon | 160/178 C |
| 1,804,811 | 5/1931 | Rosel | 160/178 C |
| 2,507,610 | 5/1950 | Nelson | 24/134 KC |
| 3,096,660 | 7/1963 | Spirakus | 74/230.3 |

*Primary Examiner*—Peter M. Caun

*Attorney, Agent, or Firm*—Poms, Smith, Lande & Glenny

[57] ABSTRACT

A cord locking device for blinds or the like having a housing adapted to be secured above a window frame or the like and a wheel rotatable mounted in the housing for receiving thereover a pair of cords connected to the blinds. The device includes clamping means which moves into clamping engagement with the cords thereby clamping the cords in a locked position. The device also includes built-in guide means for guiding the cords into locking position.

7 Claims, 6 Drawing Figures

CORD LOCKING DEVICE FOR BLINDS OR THE LIKE

BACKGROUND OF THE INVENTION

1. Field of the Invention

The invention relates to cord locking device; and more particularly, to a cord locking device for securing the cords of blinds or the like in releasable position.

2. Description of the Prior Art

Various types of cord locking devices are known in the art for securing the cords of blinds, shades, or the like in a fixed, selectively releasable, position. Generally, a pair of cords or ropes or the like attached to the shades or blinds or the like pass over a roller mounted in a housing fixed above the shade or the like, such as above a window frame.

In such prior art devices, it is possible that the cords may bind or jam up in the housing between the roller and the sides or flanges of the housing in which the roller is mounted. Also, if both cords do not lock at the same time, one end of the shade or blind or the like to which the cords are attached will be lower than the other which is unaesthetically pleasing.

Such devices also have means for locking the cords internally of the housing which might result in the cords from getting stuck therein.

Such prior art devices also accomplish such locking by a wedging action which wedges the cords between a movable locking member internally mounted in the housing and an inner wall thereof. Thus, such devices are limited to cords of a predetermined diameter or else such locking action will not take place.

SUMMARY OF THE INVENTION

It is an object of this invention to provide an improved cord locking device for locking a pair of cords connected to a shade or blind or the like in a quick, secure manner while permitting quick release thereof.

It is a further object of this invention to provide an improved cord locking device for a pair of cords which cannot bind the cords and eliminates jamming of the mechanism thereof for carrying out such locking.

It is still another object of this invention to provide an improved cord locking device which firmly clamps a pair of cords between a movable locking member on the device and a stationary portion of the device.

It is still further object of this invention to provide a cord locking device which can accommodate a pair of cords of relatively small diameters and includes guide means for guiding the cords into a locking position whereby both cords lock at the same time.

These and other objects are preferably accomplished by providing a cord locking device for blinds or the like having a housing adapted to be secured above a window frame or the like and a wheel rotatably mounted in the housing for receiving thereover a pair of cords connected to the blinds. The device includes clamping means which moves into clamping engagement with the cords clamping the cords in a locked position. The device also includes built-in guide means for guiding the cords into locking position.

DESCRIPTION OF THE PREFERRED EMBODIMENT

Figure 1:
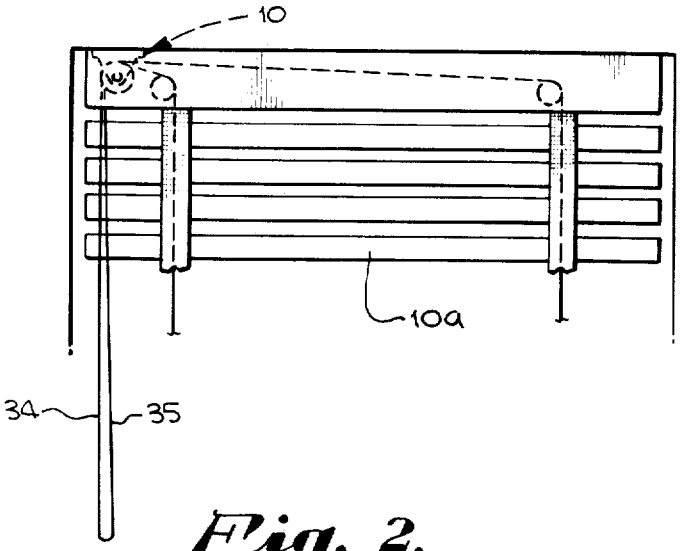
FIG. 1 is a front, elevational, view of the cord locking device mounted on a blind assembly in accordance with the invention.
Figure 2:
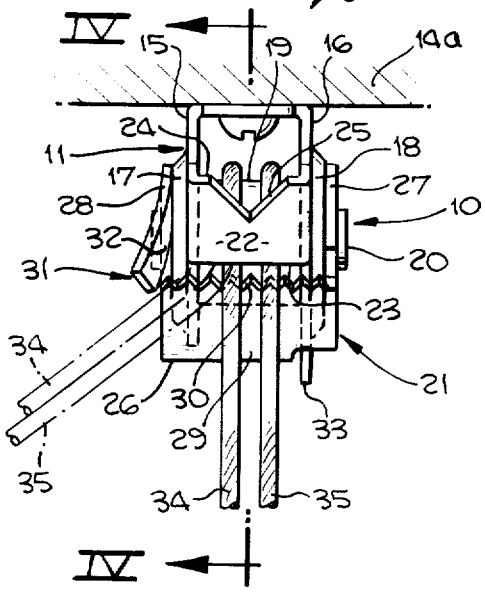
FIG. 2 is an end view of the device alone of FIG. 1.

Referring now to FIGS. 1 and 2, a cord locking device 10 is disclosed mounted on a blind assembly 10*a* having a housing 11 which includes an upper portion having apertures 13 and 14 (FIG. 4) therein for securing device 10 at a desired location, such as on a ceiling 14*a* or the like, using suitable screws 13*a*, 13*b* or the like inserted in apertures 13, 14.

Figure 5:
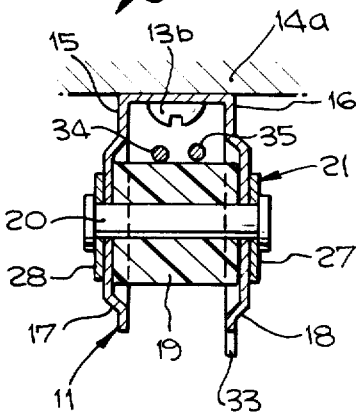
FIG. 5 is a view taken along lines V—V of FIG. 3.
Figure 4:
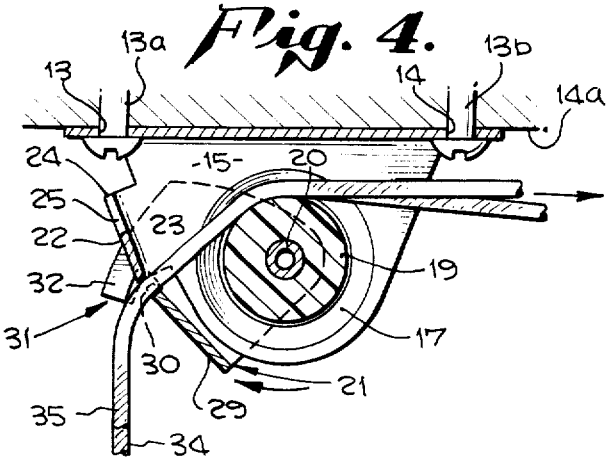
FIG. 4 is a view taken along lines IV—IV of FIG. 2.

Housing 11 includes a pair of spaced, downwardly extending side flanges 15, 16 (FIG. 2). As particularly comtemplated in the present invention, wheel means are provided in housing 11 for rotatably receiving a wheel therein. In the exemplary embodiment, such wheel means includes a pair of concave portions 17, 18 (see also FIG. 5) formed in side flanges 15, 16 respectively, conformably receiving a wheel 19 therein. As shown in FIGS. 4 and 5, wheel 19 has a smooth outer periphery and is thus generally cylindrical. Portions 17, 18 serve to retain wheel 19 in position during rotation and wheel 19 may be rotatably mounted in housing 11 about its longitudinal axis in any suitable manner, such as a pin 20 (FIG. 5) extending between flanges 15, 16 and secured on the outside thereof in any suitable manner. In this manner, wheel 19 is freely rotating and, as will be discussed, the outer periphery extends to the inner walls of flanges 15, 16 so that cords passing over wheel 19 cannot be trapped between the flanges 15, 16 and the sides of wheel 19.

As particularly contemplated in the present invention, cord clamping means 21 are provided for selectively clamping cords in a fixed position while permitting subsequent quick release thereof. In the exemplary embodiment, such cord clamping means 21 includes a stationary facing 22 interconnecting side flanges 15, 16 having a bottom linear edge 23. The upper edge 24 may include a V-shaped, cut-out portion 25 for ease in screwing a screw or the like in aperture 13, if desired. Cord clamping means 21 further includes a movable clamping member 26 which is comprised of a pair of side flanges 27, 28 which may be pivotally mounted on the outside of side flanges 15, 16 of housing 11 by the same pin 20 used for rotating wheel 19. Flanges 27, 28 are interconnected below wheel 19 by a flange 29 having serrated teeth 30 or the like along substantially the entire length thereof. Teeth 30 extend in the same plane as flange 29 away from wheel 19.

As particularly contemplated in the present invention, guide means 31 are also provided for guiding cords or the like into clamping engagement in device 10. In the exemplary embodiment of the invention, such guide means 31 includes a portion 32 of flange 28 being bent outwardly away from wheel 19 presenting a smooth-walled inner surface against which cords or the like may be pulled prior to clamping the cords, as will be discussed.

Finally, stop means 33 are provided in the form of a cam or stop or the like which may be a portion of side flange 15 at the bottom thereof against which the rear edge of flange 29 abuts when clamping member 26 moves to the FIG. 2 position.

Figure 3:
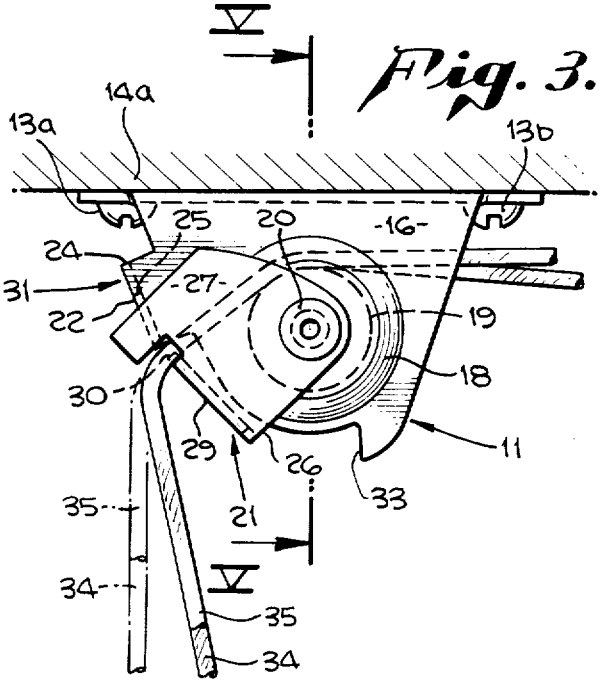
FIG. 3 is a side view of the device of FIG. 2.
Figure 6:
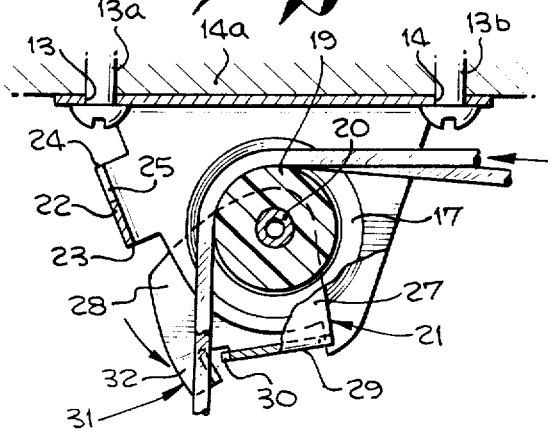
FIG. 6 is a view similar to FIG. 4 showing the operation of the device of FIG. 1.

The operation of device 10 will now be explained with particular reference to FIGS. 4 and 6. As shown in FIG. 6, a pair of pull-ropes or pull-cords 34, 35 are shown passing between teeth 30 of clamping member 26 and edge 23 of facing 22 and over and about wheel 19 down out of housing 11. These cords or ropes 34, 35 are to be understood as being connected to the blind or shade of FIG. 1, each cord or rope controlling one respective side thereof. By pulling ropes or cords 34, 35 (actually a single doubled up cord) against guide 32 (as shown in dotted lines in FIG. 2) with the weight of the shade or blind on the opposite end of cords or ropes 34, 35, in a short downward and inward movement, then release the cords at that inward point, a clamping action takes place whereby clamping member 26 is brought up to the FIG. 4 position whereby cords or ropes 34, 35 are clamped between the teeth 30 of clamping member 26 and the edge 23 of facing 22. A short pull outwardly on cords or ropes 34, 35 will release the clamping action (shown in dotted lines in FIG. 3) causing clamping member 26 to return to the FIG. 6 position whereby it abuts against stop 33 and is thus ready for a subsequent clamping action. In this manner, cords or ropes 34, 35 can be locked quickly and easily in position, then released quickly and easily by pulling cords or ropes 34, 35 to provide for a subsequent locking action.

Thus, instead of a binding action on cords or ropes 34, 35, i.e., whereby the cords or ropes are bound against the rear wall of the housing or the like, a positive clamping action takes place. The wheel 19 is smooth surfaced and encased in housing 11 in a manner preventing binding of ropes or cords 34, 35 by catching between the side walls of housing 11 and the sides of wheel 19.

The guide means 31 allows both cords or ropes 34, 35 to be guided into position prior to locking so that both ropes or cords 34, 35 lock at the same time so that the blind or shade to which they are attached are not locked with one side of the shade or blind lower than the other. This permits the use of a smooth surfaced or non-grooved wheel. Since clamping member 26 is on the outside of the housing, it cannot stick inside of the housing when in use. A more positive locking action takes place since the ropes or cords 34, 35 are actually clamped between member 26 and edge 23 and not wedged as in prior art devices. Thus, cords or ropes of small diameters may be used whereas certain smaller diameter cords or ropes might not be wedged in certain prior art devices.

Since the guide means is integral with the clamping teeth 30, when member 26 drops into the FIG. 2 position against cam or stop 33, it is immediately ready for the next locking action.

The device 10 of this invention is suitable for use as a cord lock for pull-up shades and blinds or the like having such cords, such as woven wood shades, venetian blinds, austrian shades, etc. Although only a single doubled-up cord (or a pair of cords) has been disclosed, obviously any suitable number of strands of cords may be used.

I claim as my invention:

1. In a pull-cord locking device for pull-up shades, blinds, or the like having a housing, said housing having a top wall and a pair of downwardly extending side walls, aperture means in said top wall for securing said housing in a position above a shade, blind or the like, a rotatable wheel rotatably mounted in said housing between said side walls for receiving a pull-cord connected to said shade, blind or the like over said wheel and down below said housing, and pull-cord locking means associated with said housing movable from a first position out of locking engagement with said pull-cord in a fixed position with respect to said housing, the improvement which comprises:

said pull-cord locking means including pull-cord clamping means comprising a stationary facing having an upper edge and a lower edge mounted on said housing extending generally parallel to the axis of rotation of said wheel between said side walls, and a clamping member including a front wall interconnected by a pair of side flanges pivotally mounted on the outside of said side walls and said front wall being movable from a first position below and remote from the lower edge of said facing to a second position substantially abutting against the lower edge of said facing to thereby clamp said pull-cord between said front wall and said facing when a pull-cord is inserted into said housing between said facing and said wheel and over said wheel down out of said housing, said front wall being generally parallel to said facing and said side walls including generally circular concave portions therein opening into the interior of said housing having midpoints lying along generally the axis of rotation of said wheel and of a diameter slightly greater than the diameter of said wheel for receiving said wheel therebetween in a manner preventing binding of a pull-cord passing over said wheel between the sides of said wheel and the side walls of said housing, the outer periphery of said wheel being substantially smooth on substantially the entire outer periphery thereof wherein no internal moving parts are present interiorly of said housing other than said wheel with said side flanges moving externally of said housing thereby presenting no moving parts to interfere with the pull-cord during clamping of said pull-cord.

2. In the locking device of claim 1 further including pull-cord guide means associated with said clamping member for guiding a pull-cord into a predetermined position prior to clamping said pull-cord between said clamping member and said facing.

3. In the locking device of claim 1 further including a plurality of teeth extending from the upper edge of said front wall in the same plane as the plane of said front wall.

4. In the locking device of claim 3 further including stop means associated with both said clamping member and said housing for stopping the downward movement of said clamping member when it moves from its second position back to its first position.

5. In the locking device of claim 4 wherein said stop means includes a stop formed on the bottom of at least one of the side walls of said housing, said lower edge of said front wall being adapted to abut against said stop when said clamping member moves from its second position back to its first position.

6. In the locking device of claim 1 wherein said housing includes pull-cord binding preventing means for preventing binding in said housing of a pull-cord passing over said wheel.

7. In a pull-cord locking device for pull-up shades, blinds, or the like having a housing, said housing having a top wall and a pair of downwardly extending side walls, aperture means in said top wall for securing said housing in a position above a shade, blind or the like, a rotatable wheel rotatably mounted in said housing between said side walls for receiving a pull-cord connected to said shade, blind or the like over said wheel and down below said housing, and pull-cord locking means associated with said housing movable from a first position out of locking engagement with said pull-cord in a fixed position with respect to said housing, the improvement which comprises:

said pull-cord locking means including pull-cord clamping means comprising a stationary facing having an upper edge and a lower edge mounted on said housing extending generally parallel to the axis of rotation of said wheel between said side walls, and a clamping member pivotally mounted on said side walls movable from a first position below the lower edge of said facing to a second position substantially abutting against the lower edge of said facing to thereby clamp said pull-cord therebetween when a pull-cord is inserted into said housing between said facing and said wheel and over said wheel down out of said housing, said clamping member including a pair of side flanges pivotally mounted on the outside of said side walls and an integral front wall interconnecting said side flanges having a lower edge and an upper edge and pull-cord guide means associated with said clamping member for guiding a pull-cord into a predetermined position prior to clamping said pull-cord between said clamping member and said facing, said guide means including at least one of the side flanges of said clamping member having a relatively smooth inner surface and being bent outwardly away from said housing presenting a smooth-walled inner surface on the inside of said bent flange against which said pull-cord may be pulled prior to clamping said pull-cord.

* * * * *